US005291820A

United States Patent [19]

Hainsworth et al.

[11] Patent Number: 5,291,820

[45] Date of Patent: Mar. 8, 1994

[54] INERTIAL RESTRAINT MECHANISM FOR RAIL-MOUNTED MISSILES

[75] Inventors: Barton J. Hainsworth, Huntington; Anton J. Kompare, Hamden, both of Conn.

[73] Assignee: United Technologies Corporation, Hartford, Conn.

[21] Appl. No.: 988,612

[22] Filed: Dec. 10, 1992

[51] Int. Cl.[5] ..... F41F 3/06

[52] U.S. Cl. ..... 89/1.806; 89/1.812; 89/1.819

[58] Field of Search ..... 89/1.806, 1.819, 1.812

[56] References Cited

U.S. PATENT DOCUMENTS

| | | | |
|---|---|---|---|
| 3,166,981 | 1/1965 | Harris et al. | 89/1.806 |
| 3,983,785 | 10/1976 | Dissmeyer et al. | 89/1.806 |
| 4,519,291 | 5/1985 | Seeger et al. | 89/1.806 |
| 4,660,456 | 4/1987 | Griffin et al. | 89/1.819 |
| 5,094,140 | 3/1992 | Williams | 89/1.806 |

*Primary Examiner*—David H. Brown
*Attorney, Agent, or Firm*—Michael Grillo

[57] ABSTRACT

An inertial restraint mechanism restrains a rail mounted missile against forward movement along a missile launch rail in response to a deceleration force. The restraint mechanism comprises a mass the movement of which is opposed by a spring force. When the mass overcomes the spring force due to a deceleration force in excess of a threshold magnitude, a locking mechanism is activated to a missile restraining position, thereby restraining the missile against forward movement. The restraint mechanism is locked in the missile restraining position to prevent release of a missile in response to multiple deceleration forces experienced by the missile and launch rail. Additionally, a detent may be provided which prevents actuation of the restraint mechanism to the missile restraining position unless the missile is stored in a storage compartment.

9 Claims, 6 Drawing Sheets

INERTIAL RESTRAINT MECHANISM FOR RAIL-MOUNTED MISSILES

This invention was made under a Government contract and the Government has rights herein.

TECHNICAL FIELD

This invention relates to missile launchers for launching rail-mounted missiles, and more particularly, to a locking mechanism which restrains rail-mounted missiles during a forward crash situation.

BACKGROUND OF THE INVENTION

Aircraft missiles are generally mounted to launchers which are fixed to the aircraft. In this manner, the missile can be launched from the launcher, while the launcher remains fixed to the aircraft. As is well known in the art, missiles used with a rail-type launcher are provided with a plurality of T-shaped hangers from which the missile is suspended on the rail. The T-shaped hangers are commonly referred to as "shoes".

In some aircraft, such as combat helicopters, missile launchers are movable between a deployed position and a stowed position. In the stowed position, the missiles are stored in missile compartments within the aircraft for maximum aerodynamic efficiency. The launchers may be retracted directly upward into the aircraft with the missile suspended below a launch rail. Alternatively, the launch rail may be pivoted approximately 90° into the missile compartment with the missile held in a side-ward position on the launch rail.

Each launch rail is provided with a missile hold-back latch that restrains the missile against forward movement on the rail. The hold-back latch is spring loaded and contacts one of the shoes to hold the missile in place on the launch rail. When a missile is fired, the propulsion motor of the missile is ignited to initiate launch. When the missile's motor thrust has built up to a value which exceeds the holding spring force of the hold-back latch, the hold-back latch automatically repositions allowing the missile to be propelled forward along the launch rail. The rocket motor thrust required to override the hold-back latch retention force is approximately six-hundred pounds, which is equivalent to approximately six g's.

When an aircraft such as a helicopter experiences a forward crash situation, the aircraft airframe is subject to deceleration forces as high as twenty g's. Since the aircraft launcher hold-back latch is designed to release a missile at a force equivalent to approximately six g's, it is likely that the missiles will be released from their launchers during a forward crash condition. If a missile is released from its launch rail while stored in the missile compartment, it may travel into the cockpit area endangering the pilot and copilot.

DISCLOSURE OF INVENTION

Objects of the inventions include provision of an aircraft missile launcher for carrying a rail-mounted missile, the launcher having an inertial restraint mechanism which restrains the missile against forward movement in a forward crash situation wherein the aircraft experiences a high deceleration.

According to the present invention, an inertial missile restraint mechanism comprises a mass the movement of which is opposed by a spring force, and in response to a deceleration in excess of a threshold loading, the mass overcomes the spring force and activates a locking mechanism to restrain a rail-mounted missile against forward movement.

According to a first embodiment of the present invention, the mass is pivotal against a torsion spring force, and when the mass overcomes the spring force due to deceleration, it pivots into a missile restraining position in the path of a missile shoe, thereby restraining the missile against forward movement.

In further accord with the first embodiment of the present invention, when a deceleration causes the mass to pivot into the path of a missile shoe, it is locked into its missile restraining position.

In still further accord with the first embodiment of the present invention, the mass may only pivot into the path of a missile shoe when the missile is stored in a missile compartment.

According to a second embodiment of the invention, when the mass overcomes the spring force, a plunger is released which locks a missile hold-back latch in a missile restraining position, thereby restraining the missile against forward movement.

In further accord with the present invention, once the restraint mechanism is repositioned to the missile restraining position, the restraint mechanism may be repositioned to the disengaged position by manual actuation.

The present invention provides a significant safety advantage over prior art missile launch systems because rail-mounted missiles are automatically restrained in forward crash situations. The spring force which opposes movement of the mass is selected such that the restraint mechanism is activated to the missile restraining position at g-levels that exceed any standard flight or landing conditions. However, the mass overcomes the spring force before the missile hold-back latch is activated due to the deceleration caused by a crash. In non-crash situations, the mass remains generally stationary under the force of the spring. Only the missile experiences forward thrust from its propulsion motor during a missile launch, and overcomes the hold-back latch when the missile forward thrust exceeds the prescribed level. Therefore, the restraint mechanism is only activated during forward crash conditions, and inadvertent missile retention is prevented. Once the restraint mechanism has been activated, an operator may manually deactivate the mechanism for missile removal. Alternatively, the launch rail and missile may be removed together from the damaged aircraft.

The foregoing and other objects, features and advantages of the present invention will become more apparent in light of the following detailed description of exemplary embodiments thereof, as illustrated in the accompanying drawings.

BEST MODE FOR CARRYING OUT THE INVENTION

The inertial restraint mechanism of the present invention is particularly well suited for use with an aircraft missile launch system of the type having a launch rail for restraining a rail mounted missile against forward movement in a forward crash situation.

Figure 1:
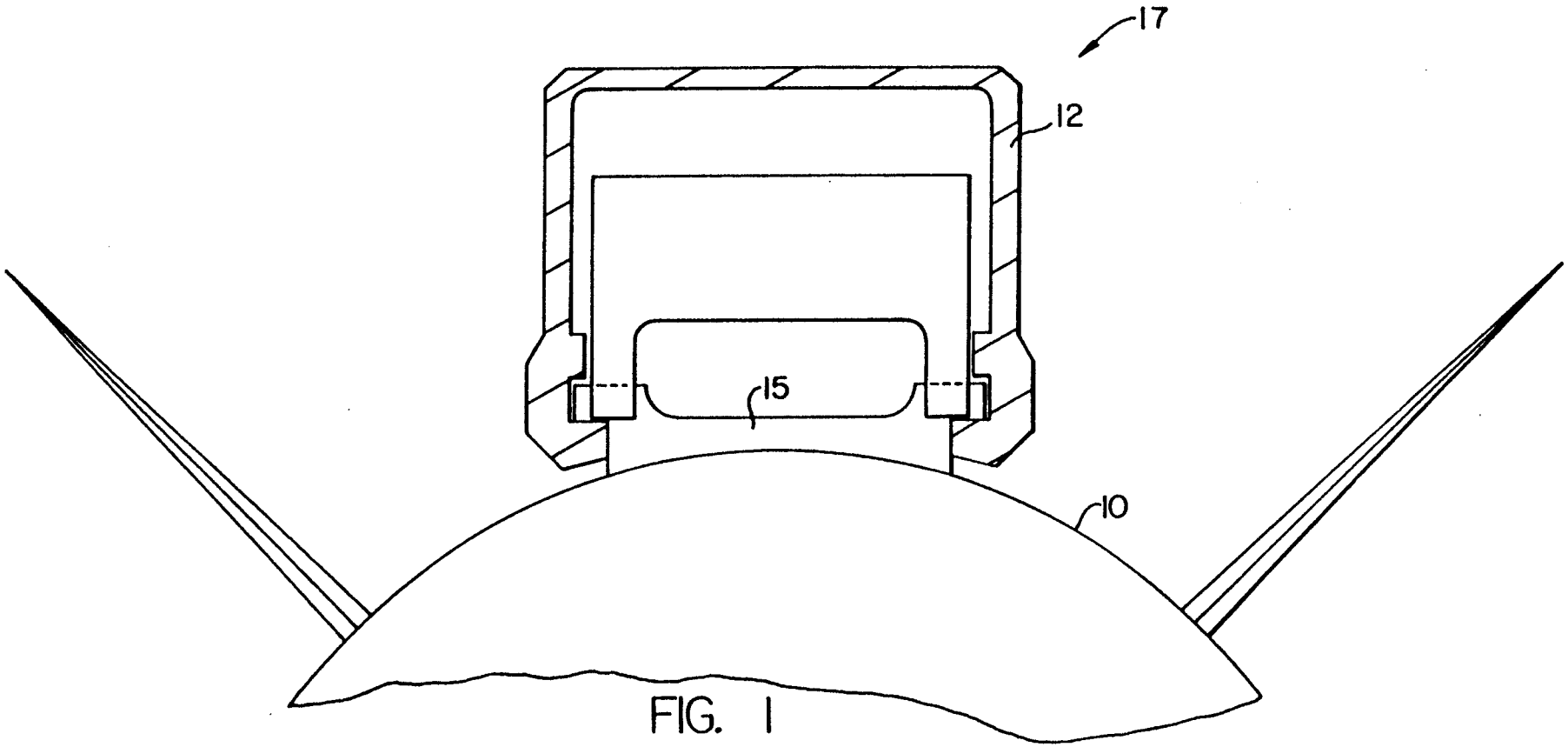
FIG. 1 is a cross-sectional view, partially broken away, of a missile suspended from a launch rail by a missile shoe.

Referring to FIG. 1, a missile 10 is suspended from a missile launch rail 12 by a T-shaped hanger 15. It is common in the art to refer to the T-shaped hanger as a missile "shoe". The missile is provided with a plurality of shoes 15 for suspending the missile from the rail 12. As described hereinbefore, each launch rail is provided with a missile hold-back latch 17 that restrains the missile against forward movement on the rail. The hold-back latch 17 is spring loaded and contacts one of the shoes to hold the missile in place on the launch rail. When a missile is fired, the propulsion motor thrust builds up to a value which exceeds the holding spring force of the hold-back latch, and the hold-back latch automatically repositions allowing the missile to be propelled forward along the launch rail.

Figure 2:
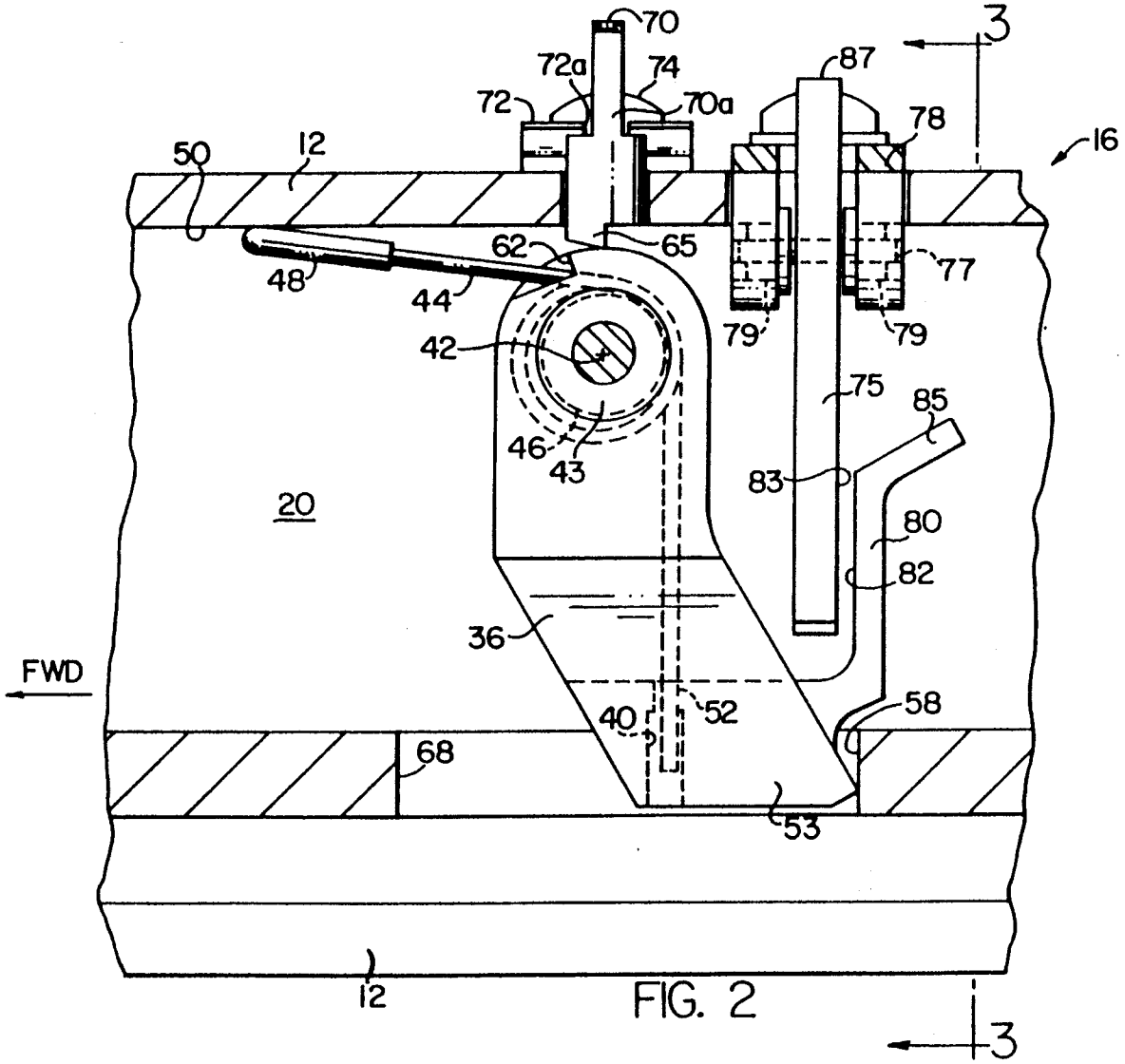
FIG. 2 is a cross-sectional view of a first embodiment of an inertial restraint mechanism of the invention taken substantially along line 2—2 of FIG. 3 showing the mechanism in a disengaged position.
Figure 3:
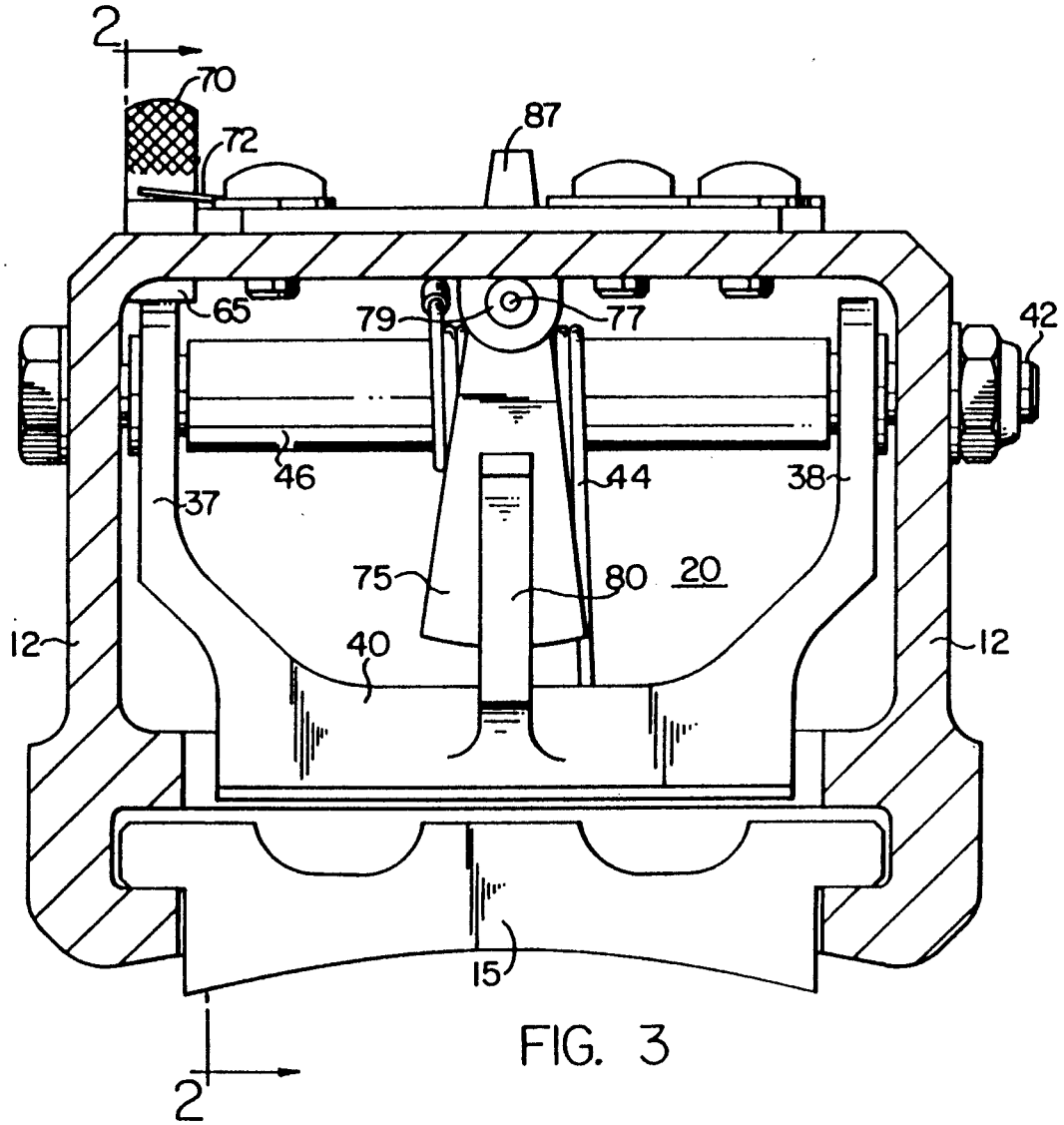
FIG. 3 is a cross-sectional view taken substantially along line 3—3 of FIG. 2.

The inertial restraint mechanism of the embodiment illustrated in FIGS. 2, 3, 4 and 5 is intended to restrain a missile by preventing forward movement of one of the missile shoes. Referring to FIGS. 2 and 3, the inertial restraint mechanism 16 is shown in a disengaged position. The restraint mechanism comprises an inertial latch 36 (mass) having a pair of latch arms 37, 38 connected by a cross-member 40. The arms 37,38 support the mass for pivotal movement about a pivot axis 42. A bearing 43, e.g., a frictionless flanged bearing, may be positioned between the arms 37,38 and the pivot axis 42 to allow the latch to freely pivot about the axis. The mass 36 is pivotally attached within a hollow center 20 of the launch rail 12 such that it may swing forward against the force of a torsion spring 44 during a crash wherein the aircraft experiences a deceleration exceeding some predetermined threshold. The pivot axis 42 may comprise a bolt or pin fixed to the launch rail 12.

The torsion spring 44 is mounted on a mandrel 46 located over the pivot axis 42 and centered between the arms 37,38. One spring leg 48 reacts against a top wall 50 of the launch rail, and the other 52 against the latch cross member 40. The torsion spring 44 applies a force to pivot the latch about the pivot axis 42 such that a stop member portion 53 of the latch furthest from the pivot axis 42 contacts an aft stop 58.

Figure 4:
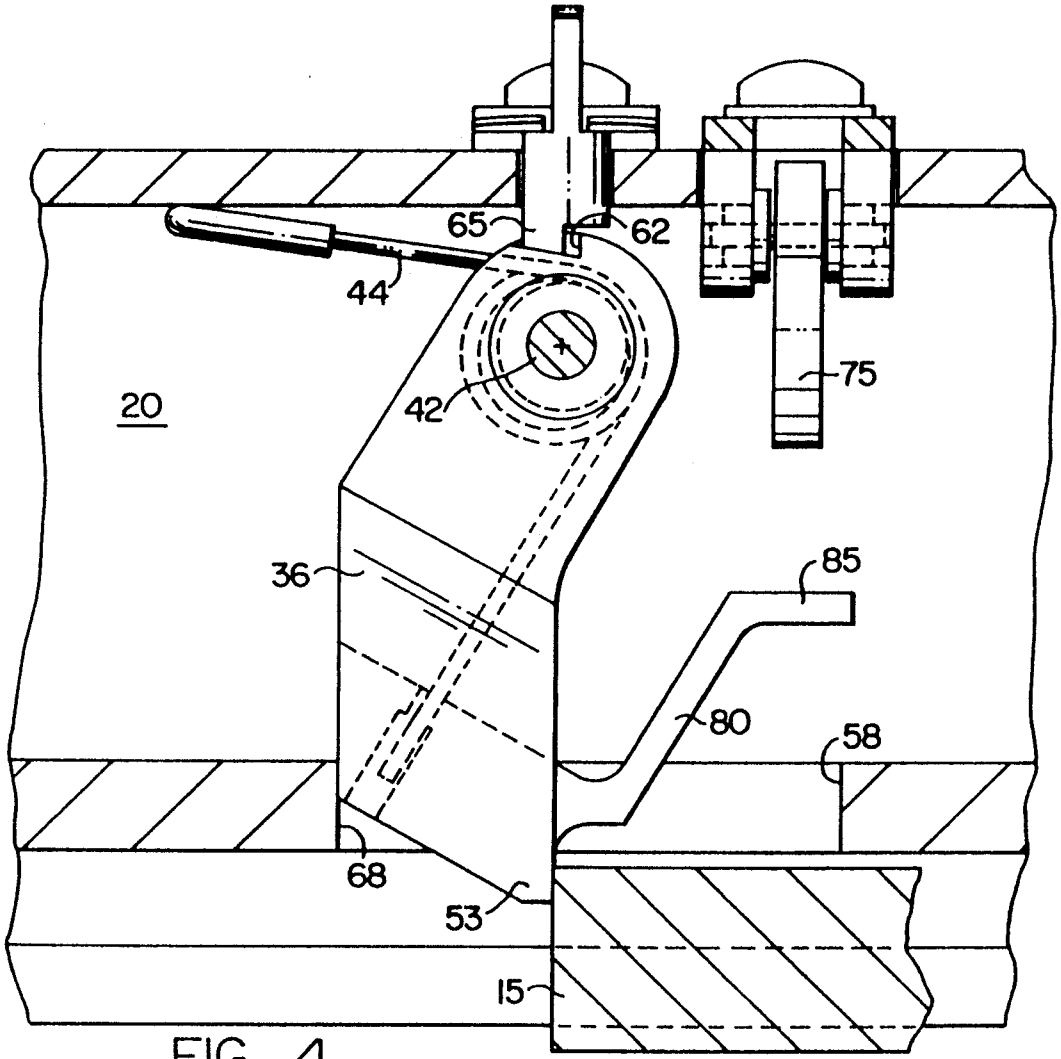
FIG. 4 is a cross-sectional view similar to FIG. 2 showing the mechanism in the missile restraining position.

Referring to FIG. 4, when the latch rotates forward a sufficient distance from its normal position against the aft stop 58, a ratchet tooth 62 at the tip of one of the latch arms 37 trips a spring-loaded pawl 65, which prevents aft rotation of the latch beyond the pawl trip point. The latch may continue to rotate until it contacts a forward stop 68 and rebounds to the point where the tooth 62 positively engages the pawl 65. In this, the missile restraining position, the stop member 53 protrudes into the path of the missile shoe 15. The position of the latch relative to the shoe is such that, during a forward crash sufficient to overcome the hold-back latch, the latch stop member 53 will have time to swing into the missile restraining position before the sliding shoe arrives at its location.

The force of impact of the missile shoe against that latch is shared between the forward stop 68 and the pivot 42, in proportion determined by the relative distance of each of these members from the point of impact. The forward stop acts as the fulcrum of a first-degree lever, represented by the latch. The closer the fulcrum lies to the point of impact, the less strength and consequently the less mass is required near the pivot axis. Also, the further the latch center of gravity lies from the axis, the more effective the mass becomes inertially, in the manner of a flywheel. Therefore, locating both the latch center of gravity and the forward stop closer to the impact point is beneficial from a weight savings standpoint. Additionally, orienting the latch perpendicular to the direction of the crash loading provides the most efficient use of the latch mass by maximizing the moment arm of the deceleration force.

The latch locking feature is provided to prevent the missile from coming free of the rail in the event of multiple crash impacts. For example, a first impact would rotate the latch 36 against its forward stop 68, followed by the engagement of the shoe 15 against the back of the stop member 53 after a short interval. If the missile were to subsequently bounce back just enough to clear the latch, the latch would reset to its normal position if the locking feature was not present. If the latch were to reset, the latch may not engage in response to a second impact in sufficient time to prevent forward movement of the missile.

Figure 5:
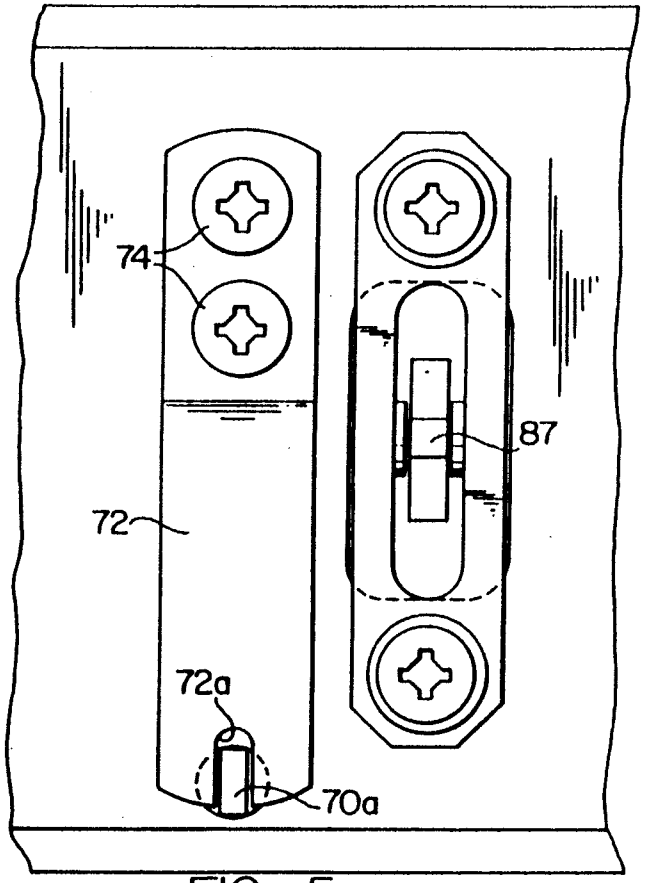
FIG. 5 is a top view of the inertial restraint mechanism of FIG. 2.

Once the latch is locked in the missile restraining position by engagement of the pawl 65 with the tooth 62, it may be reset to its normal position by resetting the pawl. Referring to FIGS. 3 and 5, a knurled tab 70 is attached to, and forms the top of the pawl 65. The pawl may be reset by manually grasping the tab and pulling it upward far enough such that the pawl disengages the tooth. The pawl is held against the latch by a flat spring 72 fixed to the top of the rail 73 by fasteners 74. The spring has a slotted end 72*a* for receiving a connecting segment 70*a* which connects the tab 70 to the pawl 65. The slot 72*a* and connecting segment 70*a* hold the pawl in proper orientation such that the pawl 65 engages the tooth 62 when the mechanism is activated to the missile restraining position.

It may be desirable to restrain a missile in a crash situation only when the missile is stowed in the missile compartment. When the missile is deployed, inadvertent activation of the restraint mechanism may cause the missile to hang fire. Referring to FIGS. 2 and 3, a gravity-operated detent 75 is provided for missiles that are stowed in a position 90° from the externally deployed, firing position. The detent 75 is a wedge-shaped flat member, mounted for pivotal movement at its narrow end about a pivot axis 77. The pivot axis 77 is formed by a dowel pin press fit into an aperture formed in the detent narrow end. The pin supports the detent for pivotal movement in a pair of bearings 79, e.g., a pair of flanged frictionless bearings, mounted in a clevis fitting 78, The clevis fitting 78 is centrally mounted through the top wall of the launch rail and located immediately aft of the latch pivot axis 42. The detent pivot axis 77 is orientated 90° relative to the latch pivot axis 42, which allows the detent 75 to swing freely from side-to-side within the hollow center 20 of the launch rail, through an arc of approximately 150°.

A tang 80 is fixed to the cross-member 40, and extends aft and upward from the cross-member. The tang is orientated such that when the latch is in the normal position, the forward face of the tang 82 is parallel to the aft face of the pivoting detent 83, and spaced a small distance behind it. The spacing is necessary to allow free side-to-side movement of the detent. With the rail in the deployed position and the aircraft is not exceeding a predetermined roll angle, the detent 75 swings in front of the tang 80, thus preventing the rotation of the latch. Referring to FIG. 3, when the rail is rotated 90° to the missile storage position in either the port or starboard side of the aircraft, the detent 74 swings clear of the tang 80, thereby allowing the inertial latch to engage during a forward crash to retain the missile on the rail.

Referring again to FIGS. 2, 3 and 5, a tip 87 of the narrow end of the detent protrudes through the top of the rail when the rail is deployed, thus providing a tactile and visual indication of the status of the detent to the ground crew.

An extension 85 is fixed to the tip of the tang which extends aft-ward and upward. If the latch is in the missile retention position (FIG. 4), the extension 85 prevents the detent from swinging down aft of the tang, which could impede the rearward rotation of the latch to the disengaged position. Once the tang moves past the detent and the latch has come to rest against the aft stop, the detent is no longer held aside by the extension and the detent can swing to its normal position directly in front of the tang when the missile is deployed.

Figure 6:
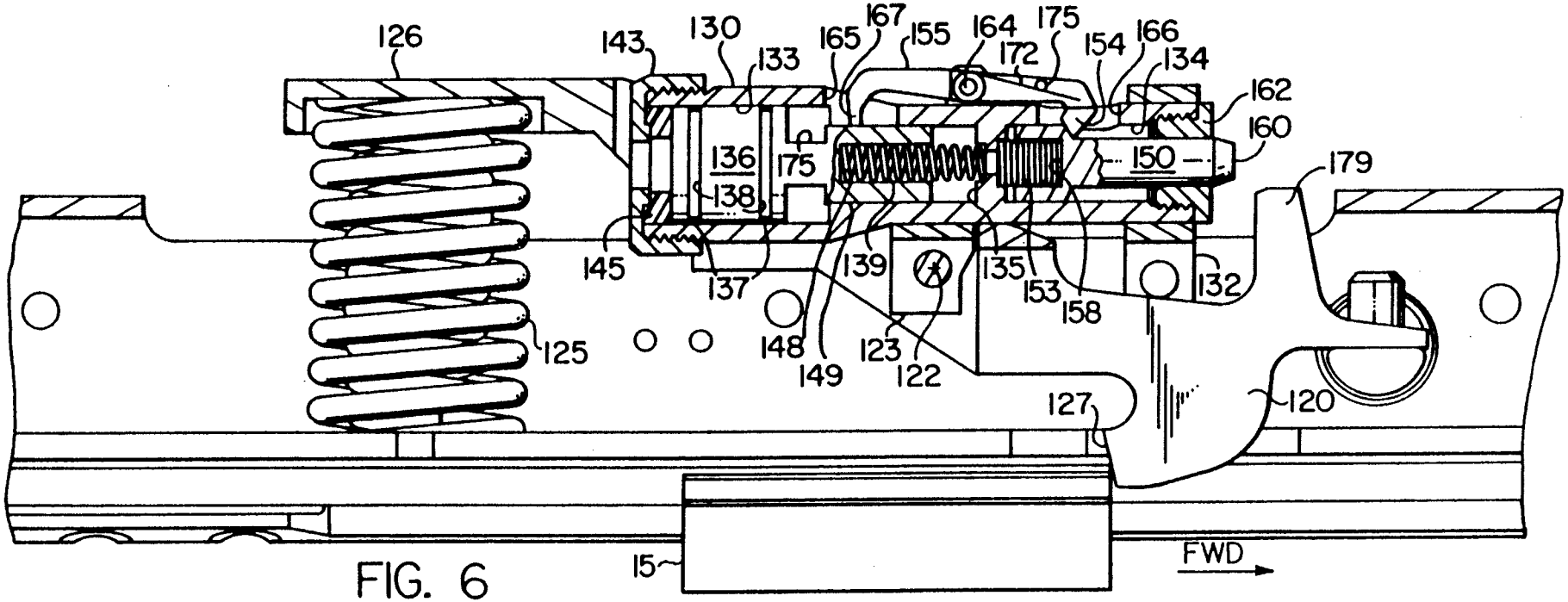
FIG. 6 is a cross-sectional view of an alternative embodiment of the inertial restraint mechanism of the present invention in the disengaged position.
Figure 7:
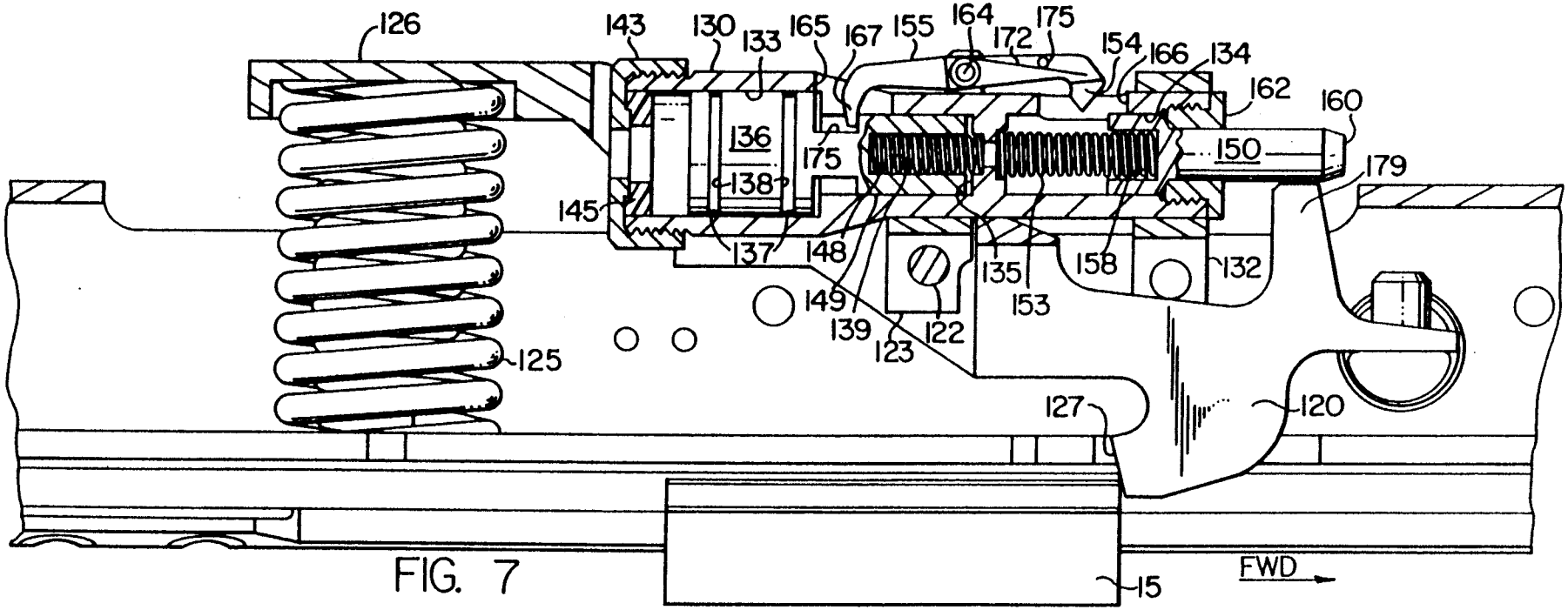
FIG. 7 is a cross-sectional view of the inertial restraint mechanism of FIG. 6 in the missile restraining position.

An alternative embodiment of the restraint mechanism of the present invention is shown in FIGS. 6 and 7. Referring to FIG. 6, once the missile is mounted on the launch rail, the hold-back latch 120 contacts one of the missile shoes 15 to restrain the missile against forward movement. The hold-back latch 120 is mounted for pivotal movement about a pivot axis 122. The pivot is supported by a bracket 123 which is attached to the launch rail assembly. A spring 125 applies a spring force to a spring retention arm 126 of the hold-back latch 120. The spring force on the arm 126 causes the hold-back latch to pivot about the pivot axis 122 to hold a missile retention surface 127 of the hold-back latch in engagement with the missile shoe 15. The spring 125 is selected such that the missile shoe 15 must exert approximately six-hundred pounds of force against the hold-back latch retention surface 127 to reposition the spring 125 for releasing the missile from the missile launch rail.

The alternative embodiment of the inertial restraint mechanism of the invention is shown in the disengaged position in FIG. 6. The restraint mechanism comprises a hollow housing 130 which is generally cylindrical in shape, and which is mounted to the launch rail by brackets 123, 132. The housing contains a slide mass compartment 133 and a plunger compartment 134 separated by a wall 135. The wall is positioned intermediate the length of the housing and is an integral part of the housing. The housing 130 is mounted on the rail such that the central major axis of the housing is parallel to the axis of the launch rail. Additionally, the slide mass compartment 133 is located towards the aft end of the rail and the plunger compartment 134 is located near the forward end of the rail.

The slide mass compartment 133 contains a slide mass 136 which is mounted for sliding movement along the axis of the rail within the slide mass compartment. The outside diameter of the slide mass 136 is slightly smaller than the inside diameter of the slide mass compartment. A pair of low coefficient-of-friction O-rings 137 are mounted on the outside diameter of the slide mass within recesses 138 formed around the outside diameter of the slide mass. The recesses 138 are formed near the opposing ends of the slide mass, and the O-rings contact the interior surfaces of the slide mass compartment. The O-rings prevent the entry of contaminants and debris between the slide mass and the slide mass compartment to ensure that the slide mass easily slides along the axis of the slide mass compartment.

A slide spring 139 applies a spring force to the slide mass 136 for forcing the slide mass against an end cap 143 of the housing. One end of the slide mass spring contacts the central wall 135 of the housing, and the other end of the spring is positioned within a channel 148 of a spring retention extension 149 mounted on an end of the slide mass 136. During assembly, the spring 139 is inserted within the slide mass compartment 133, and then the slide mass 136 is inserting, placing the spring under compression. The end cap 143 holds the slide mass and spring in place. The end cap is illustrated in threaded engagement with the housing 130; however, any suitable means of mounting the end cap to the housing may be used without departing from the scope of the present invention.

The spring 139 is under compression, and forces the slide mass towards the aft end of the rail against the end cap 143. A shock absorbent bumper 149 may be positioned between the slide mass 136 and the end cap 143 during assembly. The bumper 149 should be made of a durable, shock-absorbing material such as urethane.

The plunger compartment 134 contains a plunger 150. The plunger is also mounted for sliding movement within the plunger compartment along the axis of the launch rail. When the restraint mechanism is in the released position, the plunger 150 is held against a compressed plunger spring 153 by a plunger retention tip 154 of a pawl 155. The plunger spring 153 is held in alignment with the axis of the plunger 153 by a plunger spring cavity 158. A tip 160 of the plunger extends outside of the housing 130 within a plunger bushing 162. The bushing should be made of a durable, self-lubricating material such as oil impregnated sintered bronze. The plunger 150 is in sliding engagement with the bushing, and the bushing provides a barrier for preventing the entry of debris and contaminants within the plunger compartment 134.

The pawl 155 is mounted for pivotal movement about a pivot axis 164 on the side of the housing 130. The pivot may be supported by the bracket 123 which is attached to the launch rail assembly, or other suitable bracket means mounted to the rail or housing. A pair of apertures 165,166 are formed in the sides of the housing 130. One aperture 165 provides access to the slide mass compartment 133, and the other aperture 166 provides access to the plunger compartment 134. A slide mass tip 167 of the pawl 155 enters the slide mass compartment 133 through the one aperture 165, and the plunger retention tip 154 of a pawl 155 enters the plunger compartment 134 through the other aperture 166. When the mechanism is in the disengaged position, plunger retention tip 154 contacts the plunger 150 to hold the plunger in a position compressing the plunger spring 153. The slide mass tip 167 contacts the side of the slide mass spring retention extension 149. A torsion spring 172 is mounted on the pawl pivot 164 and contacts a spring retention tab 175 on the pawl 155. The torsion spring applies a force to the pawl which attempts to rotate it about the pivot 164 away from the plunger 150, and when the restraint mechanism is in the disengaged position, the slide mass tip 167 of the pawl 155 contacts the slide mass spring retention extension 149 preventing the pawl from rotating about the pivot axis 164.

In response to a large deceleration of the aircraft, the slide mass tends to move in the housing towards the forward end of the launch rail, and the slide mass movement is opposed by the slide mass spring 139. If the magnitude of the deceleration is great enough, the slide mass overcomes the spring force and compresses the slide spring 139. As the slide mass moves forward within the housing, the slide mass tip 167 of the pawl 155 becomes aligned with a recess 175 in the side of the slide mass so that the pawl 155 can pivot about the pivot axis 164. The recess 175 is positions between the slide mass 136 and the slide mass spring retention extension 149. As the pawl pivots about the pivot axis 164, the plunger retention tip 154 of a pawl 155 no longer engages the plunger 150, and the plunger spring 153 applies a force to the plunger 150 to slide it forward through bushing 162. Referring also to FIG. 7, when the plunger is extended in the forward position, a locking extension 179 of the hold-back latch 20 contacts the plunger 150 and the hold-back latch is prevented from pivoting about pivot axis 122. Therefore the missile shoe is locked in position and the missile is restrained against forward movement.

The first embodiment of the invention is illustrated as having a detent 75 for preventing the actuation of the inertial restraint mechanism to the missile restraining position when the missile is deployed. However, this feature is optional, and is not required in the broadest aspect of the present invention.

Although the invention has been illustrated and described with respect to exemplary embodiments thereof, it should be understood by those skilled in the art that the foregoing and various other changes, omissions and additions may be made therein and thereto, without departing from the spirit and scope of the present invention.

We claim:

1. A restraint mechanism for restraining a rail mounted missile against forward movement along a missile launch rail in response to a deceleration force, the missile being supported on the rail by a plurality of missile shoes, said restraint mechanism comprising:

a moveable mass operable between a disengaged position and a missile restraining position wherein said missile is restrained against forward movement;

means for exerting a force which opposes movement of said mass; and said mass being responsive to a deceleration force in excess of a threshold magnitude for overcoming said spring force and operating from said disengaged position to said missile restraining position.

2. A restraint mechanism according to claim 1 further comprising means which prevent the operation of said mass from said disengaged position to said missile restraining position when said missile is deployed, and which permits the operation of said mass from said disengaged position to said missile restraining position when said missile is stored in a missile stowage compartment.

3. A restraint mechanism according to claim 1 further comprising locking means for automatically locking said mass in said missile restraining position.

4. A restraint mechanism according to claim 3 further comprising an actuator for disengaging said locking means.

5. A restraint mechanism according to claim 1 wherein said moveable mass comprises:

a latch pivot axis attached to said launch rail perpendicular to the axis of said launch rail;

an inertial latch having a pair of latch arms connected by a cross-member, said latch being supported within a hollow center of said launch rail for pivotal movement about said pivot axis by said latch arms;

a stop member attached to said inertial latch, said stop member pivoting into the path of one of said missile shoes in said missile restraining position; and wherein said means for exerting a force comprises a torsion spring mounted on said pivot axis.

6. A restraint mechanism according to claim 5 further comprising:

a detent pivot axis attached to said launch rail perpendicular to the axis of said latch pivot axis;

a detent member mounted for pivotal movement about the axis of said detent pivot axis, said detent member preventing the pivotal movement of said latch when said missile is deployed, said detent member permitting the pivotal movement of said latch to said missile restraining position when said missile is stored in a missile stowage compartment.

7. A restraint mechanism according to claim 5 further comprising locking means for automatically locking said latch in said missile restraining position.

8. A restraint mechanism according to claim 7 wherein said locking means comprises:

a ratchet tooth formed on one of said latch arms; and a spring loaded pawl which engages said ratchet tooth when said latch is in said missile restraining position.

9. A restraint mechanism according to claim 8 further comprising a manually operable actuator mounted to said pawl for disengaging said pawl from said ratchet tooth in response to operation of said actuator.

* * * * *